US007606387B2

(12) United States Patent
Ohara

(10) Patent No.: US 7,606,387 B2
(45) Date of Patent: Oct. 20, 2009

(54) LOUDSPEAKER CONE INCLUDING PLATED FABRIC

(76) Inventor: Hiroshi Ohara, No. 70, Lane 533, Chong-Fong Road, U-Lin Village, Lun-Tan County, Taoyuan Hsien (TW)

( * ) Notice: Subject to any disclaimer, the term of this patent is extended or adjusted under 35 U.S.C. 154(b) by 802 days.

(21) Appl. No.: 11/345,230

(22) Filed: Feb. 2, 2006

(65) Prior Publication Data

US 2007/0177758 A1 Aug. 2, 2007

(51) Int. Cl.
*H04R 25/00* (2006.01)

(52) U.S. Cl. ..... 381/428; 381/426

(58) Field of Classification Search ..... 381/423, 381/426, 428, 432; 181/169, 196
See application file for complete search history.

(56) References Cited

U.S. PATENT DOCUMENTS 7,311,174 B2 * 12/2007 Hayakawa et al. ..... 381/428
7,344,001 B2 * 3/2008 Inoue et al. ..... 381/428

* cited by examiner

*Primary Examiner*—Suhan Ni
(74) *Attorney, Agent, or Firm*—Birch, Stewart, Kolasch & Birch, LLP

(57) ABSTRACT

A loudspeaker cone including a plated fabric is provided. The material of the loudspeaker cone is produced by laminating an interweaved plated fabric, and a light-weight and tough cloth together, and then a loudspeaker cone is produced by molding the material of the loudspeaker cone under high temperature and high pressure. The produced loudspeaker cone is light-weight, tough, pressure-resistant, not easily deformed, and can be used for a long term.

2 Claims, 4 Drawing Sheets

LOUDSPEAKER CONE INCLUDING PLATED FABRIC

FIELD OF THE INVENTION

The present invention relates to an element used in a loudspeaker, and more particularly to a loudspeaker cone including a plated fabric.

BACKGROUND OF THE INVENTION

A typical dynamic loudspeaker usually includes a motive power system, a loudspeaker cone, and a suspension system, in which the motive power system includes a permanent magnet A, an upper iron plate B, gap C, and a voice coil D. The loudspeaker cone E, which is a diaphragm for moving air, is usually formed as a conically shaped or semi-spherically-shaped acoustic bowl. The suspension system composed of a damper and an annular suspension member is provided for drawing the loudspeake cone to move in a specified direction.

The loudspeaker works in such a way that a magnetic force perpendicular to the directions of a current and a magnetic field of the permanent magnet is generated by flowing the current through the voice coil suspended inside the permanent magnet of the loudspeaker, and the generated magnetic force will cause the movable coil to oscillate up and down within a gap (a space between the voice coil and the permane magnet), and thereby the loudspeaker cone attached to the voice coil is able to vibrate up and down and reproduce sound at the frequency of the applied electrical signal. Therefore, the electrical energy can be converted into the sound energy in a loudspeaker.

Generally, the conventional loudspeaker cone is made of paper, cloth, metal material or the like. The material used depends on the desired acoustic quality, strength, and the like. For example, the paper cone is cheap, but it is not strong enough, and is easily broken up due to high frequency vibration, and the acoustic quality will be poor if a hole is formed in the louspeaker cone.

The metal cone is strong enough, but it is heavyweight and expensive.

The cloth cone is cheaper than the metal cone, but it is not strong enough, has poor pressure-resistance, and is easily deformed after long-term use.

SUMMARY OF THE INVENTION

The objective of the present invention is to solve the problems of the easy breakup of the paper cone, the heavyweight and the high cost of the metal cone, the easy deformation of the cloth cone, and the like.

To achieve the foregoing objective, the present invention provides a loudspeaker cone including a plated fabric. The plated yarn thread is made by winding a metal-plated yarn tightly around a bundle of fiber yarns. The plated yarn threads are further interwoven into the plated fabric. The plated fabric and the cloth common used to make a loudspeaker cone are respectively cut into the shape of a cone, and then the cutted plated fabric and the cloth are overlapped together, and a loudspeaker cone having double-layered structure is produced during molding under high temperature and high pressure. The loudspeaker cone of the present invention is lightweight and have enough strength and toughness to withstand a certain amount of abuse. The loudspeaker cone of the present invention can eliminate the problems of the loudspeaker cone made of paper, metal, or a single layer of cloth, and also can meet the requirement for receiving vibration.

As comparing with the conventional loudspeaker cones, the advantages of the loudspeaker cone composed of plated fabric and cloth overlapped together in accordance with the present invention are as follows:

1. If the thickness of the conventional loudspeaker cone is 1 unit, the plated fabric and the cloth in the loudspeaker cone having the double-layered structure will be respectively set to 0.5, and 0.5 unit. In other words, the thickness of the loudspeaker cone of the present invention is the same as that of the conventional loudspeaker cone. Therefore, the loudspeaker cone of the present invention not only has enough strength and toughness, which make it suitable for long term use, but also has lightweight.
2. The plated yarn thread is made by winding a very thin plated yarn tightly around a bundle of fiber yarns so that the weight of the loudspeaker cone only increases a little, and thereby the loudspeaker cone of the present invention is still lightweight.
3. The loudspeaker cone of the present invention has double-layered structure composed of a cloth which has enough elasticity, and a plated fabric which has enough strength, and thereby the loudspeaker cone of the present invention not only has excellent acoustic quality, but also has improved wear resistance.
4. The interwoven metal-plated fabric is formed as an upper layer, and the cloth is formed as a lower layer of the loudspeaker cone of the present invention. When the loudspeaker cone is arranged in the loudspeaker, the upper layer will face the front of the loudspeaker. Therefore, the loudspeaker look more artistic when the glossy metal is seen from the front of the loudspeaker.

The foregoing and other objects, features, aspects and advantages of the present invention will become better understood from a careful reading of a detailed description provided herein below with appropriate reference to the accompanying drawings.

BRIEF DESCRIPTION OF THE DRAWINGS

The drawings included herein provide a further understanding of the invention. A brief introduction of the drawings is as follows.

DETAILED DESCRIPTION OF THE PREFERRED EMBODIMENT

Figure 1:
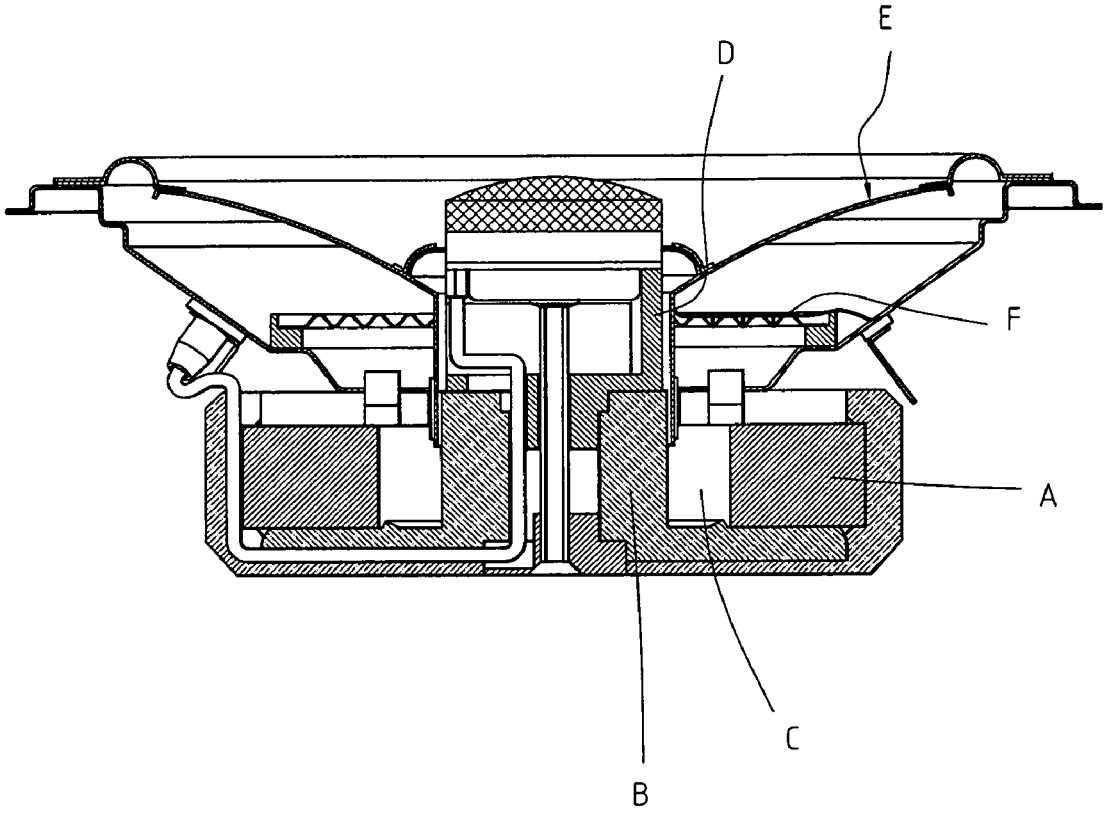
FIG. 1 (PRIOR ART)
FIG. 1 is a cross-sectional view of the loudspeaker known in the prior art.
Figure 2:
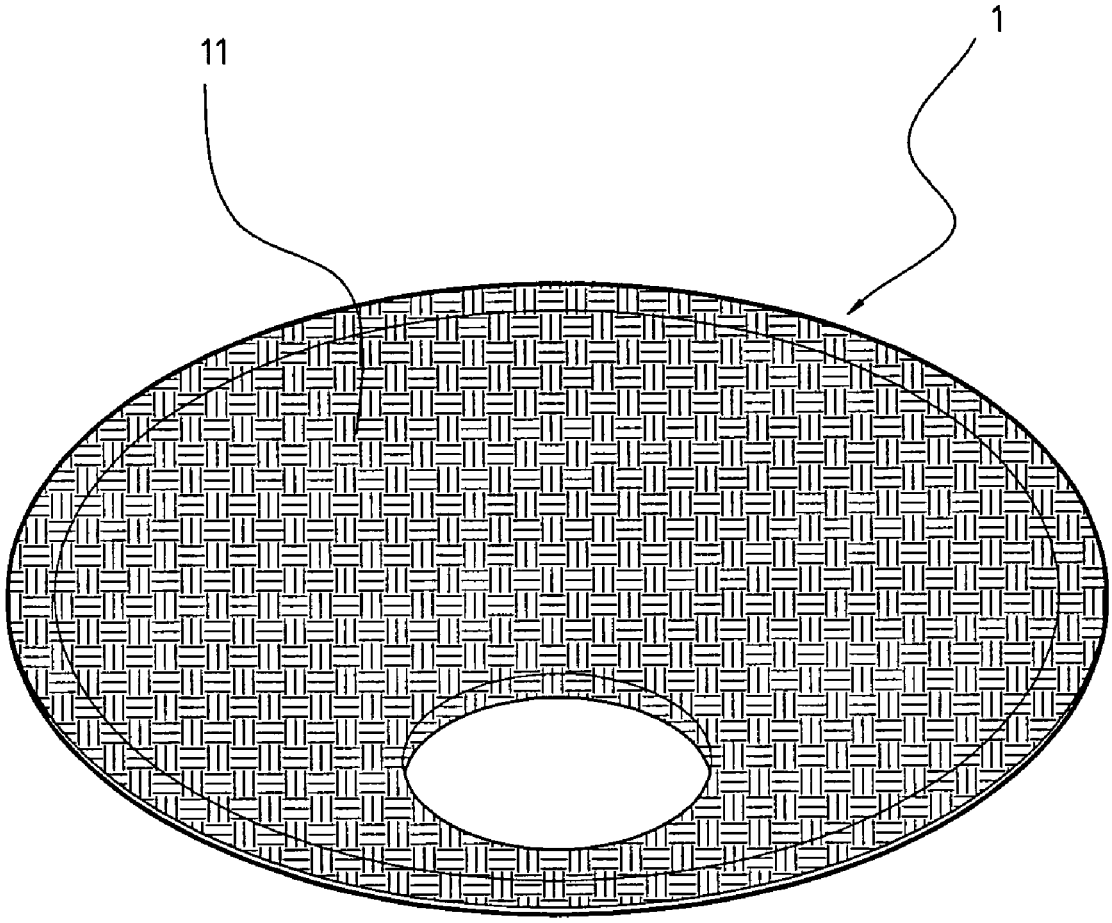
FIG. 2 is a perspective view of the loudspeaker cone in accordance with the present invention.
Figure 3:
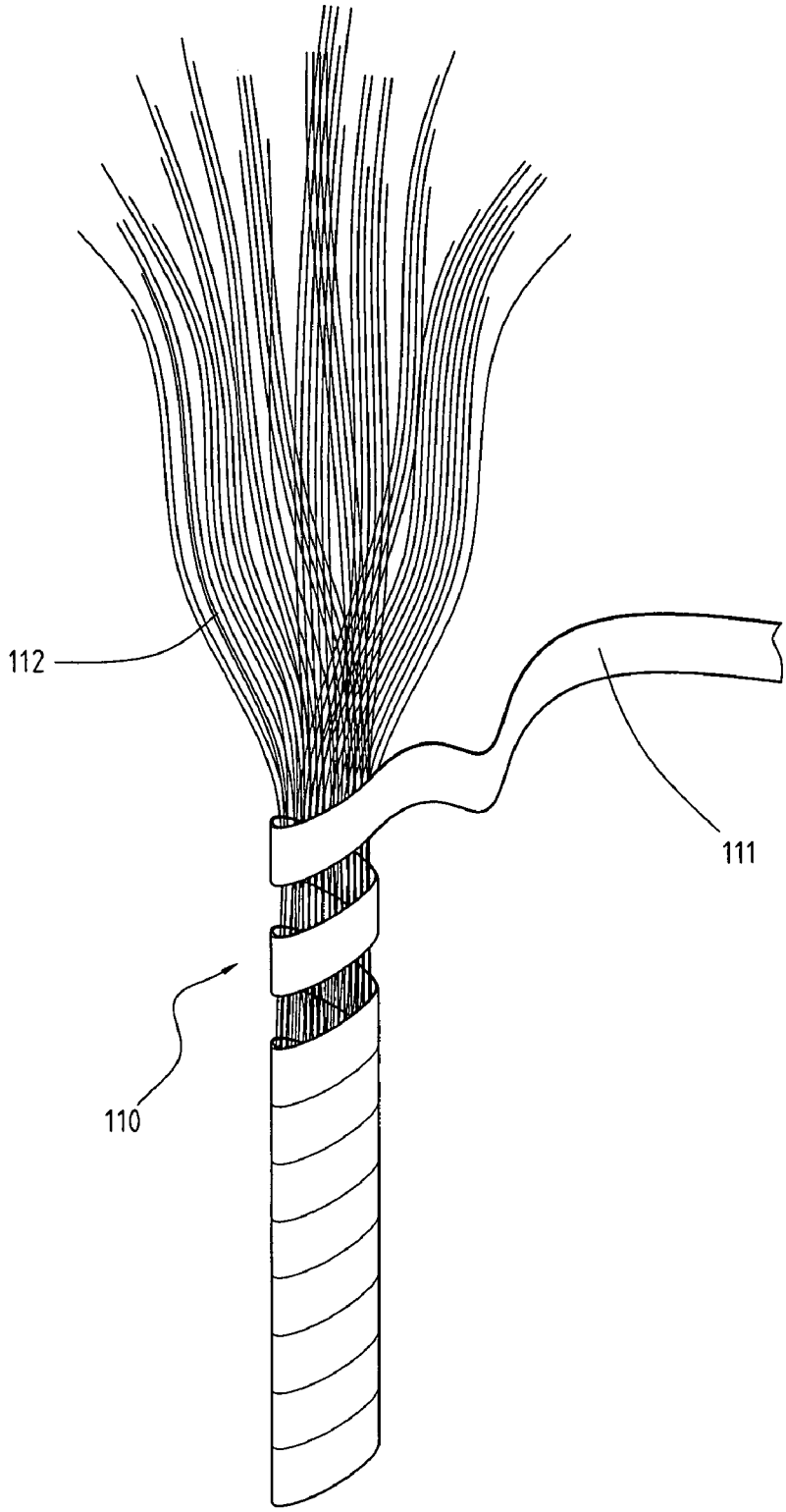
FIG. 3 is a view of a plated yarn thread made by winding a long strip of a plated yarn tightly around a bundle of fiber yarns in accordance with the present invention.

As shown in FIG. 3, a plated yarn thread structure 10 is made by winding a pre-made long strip of a plated yarn 111 tightly around a bundle of fiber yarns 112. The plated yarn thread structures 110 are further interwoven into the plated fabric 11 by using weaving techniques. The plated fabric 11 and the cloth 12 common used to make a loudspeaker cone are respectively cut into the shape of a cone, and then the cutted plated fabric 11 and cloth 12 are overlapped together, and a loudspeaker cone 1 (as shown in FIG. 2) is produced during molding under high temperature and high pressure.

Figure 4:
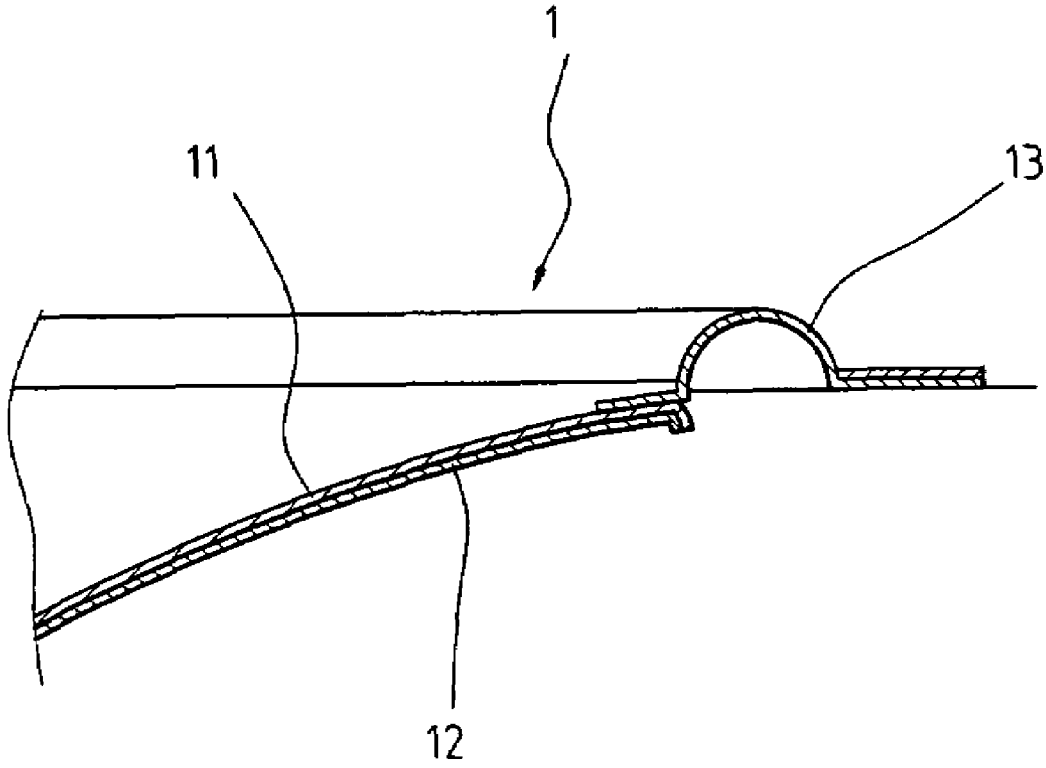
FIG. 4 is a local cross-sectional view of the loudspeaker cone in accordance with the present invention.

FIG. 4 is a local cross-sectional view of the loudspeaker cone in accordance with the present invention. The loudspeaker cone 1 has a double-layered structure composed of a top plated fabric 11, and a bottom material 12 common used to make a loudspeaker cone. The outer marginal edge of a loudspeaker cone 1 is connected to the inner marginal edge of the an annular suspension member 13. The outer marginal edge of the annular suspension member 13 is attached to the mounting flange of the loudspeaker frame (not shown) so that the loudspeaker cone 1 can be affixed to the loudspeaker frame. The loudspeaker cone 1 has a double-layered structure composed of a material 12 common used to make a loudspeaker cone and a plated fabric 11, and the material 12 common used to make a loudspeaker cone and a plated fabric 11 are overlapped together. If the thickness of the conventional loudspeaker cone is 1 unit, the thickness of the plated fabric 11 and the thickness of the material 12 common used to make a loudspeaker cone will be respectively set to 0.5 unit. The surface material including the plated fabric 11 is made into a loudspeaker cone 1 during molding. Then, the outer marginal edge of a loudspeaker cone 1 is connected to the inner marginal edge of the an annular suspension member 13. Examples of the material 12 common used to make a loudspeaker cone include cloth, paper, plastic, and other materials suitably used to make a loudspeaker cone.

It will be apparent to those skilled in the art that various modifications and variations can be made in the present invention without departing from the spirit or scope of the present invention. Thus, it is intended that the present invention cover the modifications and the variations of this invention provided they come within the scope of the appended claims and their equivalents.

What is claimed is:

1. A loudspeaker cone including a plated fabric, comprising:

a material common used to make the loudspeaker cone; and a plated fabric interwoven by plated yarn threads, wherein the material and the plated fabric are overlapped together, and molded under high temperature and pressure into the loudspeaker cone.

2. The loudspeaker cone as claimed in claim 1, wherein the plated yarn threads each is made by winding a plated yarn tightly around a bundle of fiber yarns.

* * * * *